US007372351B2

(12) United States Patent
Ikeda

(10) Patent No.: US 7,372,351 B2
(45) Date of Patent: May 13, 2008

(54) RADIAL LEAD TYPE INDUCTOR

(75) Inventor: Takeshi Ikeda, Gunma (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 11/765,339

(22) Filed: Jun. 19, 2007

(65) Prior Publication Data

US 2008/0001697 A1 Jan. 3, 2008

(30) Foreign Application Priority Data

Jun. 20, 2006 (JP) ..... 2006-196161

(51) Int. Cl.
*H01F 27/02* (2006.01)
*H01F 27/29* (2006.01)

(52) U.S. Cl. ..... 336/83; 336/192; 336/198

(58) Field of Classification Search ..... 336/93, 336/223, 232, 192, 198, 180, 182
See application file for complete search history.

(56) References Cited

U.S. PATENT DOCUMENTS 6,842,101 B2 * 1/2005 Maguire et al. ..... 336/198
6,847,281 B2 * 1/2005 Kolarsky ..... 336/90
2005/0212643 A1 * 9/2005 Kuroiwa et al. ..... 336/200
2007/0188281 A1 * 8/2007 Iguchi et al. ..... 335/299

FOREIGN PATENT DOCUMENTS

JP 63028007 A * 2/1988
JP 2-76804 6/1990
JP 04364008 * 12/1992
JP 08255716 A * 10/1996
JP 09045547 A * 2/1997
JP 2004079917 A * 3/2004

* cited by examiner

*Primary Examiner*—Anh Mai
(74) *Attorney, Agent, or Firm*—Knobbe Martens Olson & Bear LLP

(57) ABSTRACT

A radial lead type inductor is disclosed. The trailing wire of the winding extends from the inner side of the other collar, which faces against the one collar, to the outer side of the collar through an arbitrary position on the circumference of the other collar, extends back from the outer side to the inner side of the collar through the outer side of the collar and through a position, which is different from the arbitrary position, on the circumference of the other collar, and is led from the lead section of the one collar through the outer circumference of the winding. Therefore, the difference between the position of the end of a desired turn of the winding wound about the drum core and a position of the lead sections of the one collar can be absorbed, and the number of turns of the wire can be adjusted in detail below one turn.

5 Claims, 4 Drawing Sheets

PRIOR ART

RADIAL LEAD TYPE INDUCTOR

BACKGROUND OF THE INVENTION

1. Field of the Invention

The present invention relates to a radial lead type inductor to be used as a power choke coil, for example, in various electronic appliances.

2. Description of the Related Technology

A radial lead type inductor to be used as a power choke coil, for example, in a consumer electronic appliance or an industrial electronic appliance has a wire including a copper wire insulated with polyurethane, which is wound about a scroll of a drum core. The beginning and end of the wound wire are led in parallel from lead sections such as grooves and holes, which are spaced apart with a predetermined pitch, in one collar of the drum core and are fixed to the lead sections with an adhesive. The beginning and end of the led wire are used as lead terminals by removing the insulating coating. In the radial lead type inductor, the lead terminals are inserted to lead inserting holes in a circuit substrate of various electronic appliances and are conductively connected to a land electrode partially in a wiring pattern of the circuit substrate by flow soldering to implement. More specifically, as disclosed in JP-UM-A-2-76804, a drum core has two semicircular grooves, which face against each other and fix coil ends, on the outer circumference of a flange part, and a wire is wound between a pair of collars of the drum core, and the ends of the wire extend along the grooves.

In recent years, the reduction of power consumption in electronic appliances is strongly needed, and there has been a strong tendency to provide an inductor for use in a power supply circuit having a desired inductance value, which is optimum for a circuit.

However, in a radial lead type inductor as in the related art, as a part is shown in FIG. 7, the beginning 105*a* and end 105*b* of a wire 105 are led to a drum core 101, and a pair of grooves 106*a* and 106*a* of one collar 103 of the drum core 101 are placed against each other at positions displaced 0.5 T (turn) about the axial center of the drum core 101. For this reason, in the radial lead type inductor 100 having a smaller inductance value since the number of layer of the wire 105 wound about the drum core 101 is one or below, the number of turns of the wire 105 wound about the drum core 101 is in blocks of 1.0 T, such as 5.5 T, 6.5 T and 7.5 T. Therefore, the inductance value of the radial lead type inductor 100 is equal to the step width, which is equivalent to 1.0 T of the wire, and it is difficult to meet the need.

As disclosed in JP-UM-A-2-76804, the positions of the grooves 106 may be changed in accordance with the number of turns of the wire wound about the drum core 101. However, in this case, the changed pitch is different from a standard lead pitch used for a radial lead type electronic part automatic inserting apparatus to be used for installing the radial lead type inductor onto a circuit substrate, and the automatic inserting apparatus is no longer usable, which is a problem.

SUMMARY OF CERTAIN INVENTIVE ASPECTS

Certain inventive aspects relate to a radial lead type inductor, which can address detail needs for inductance values by adjusting the number of turns of a wire thereof in blocks of about 1.0 or smaller turns and thus interpolating a middle inductance value though the middle inductance value is difficult to obtain in the radial lead type inductor of the related art, as listed below.

There is provided, according to the invention, (1) a radial lead type inductor, comprising a drum core comprising a scroll and first and second collars provided at first and second ends, a winding formed by a wire wound about the scroll of the drum core, and lead terminals, which are formed by the beginning and end of the wire led in parallel from lead sections spaced apart with a predetermined pitch in the first collar, wherein the trailing wire of the winding extends from the inner side of the second collar to the outer side of the second collar at a first position on the circumference of the second collar, and extends back from the outer side to the inner side of the second collar at a second position, which is different from the first position on the circumference of the second collar, and extends to the first collar across the outer circumference of the winding (which is called first solving means).

(2) The wire may extend across the outer circumference of the winding without contact with the surface of the winding (which is called second solving means).

(3) Multiple latches for latching the lead extending across the circumference of the other collar of the drum core may be provided on the collar with an equal angle (called third solving means).

(4) The other collar of the drum core may have a polygonal shape (called fourth solving means).

The advantage by the first solving means is as follows. That is, since the trailing wire of the winding extends from the inner side of the second collar to the outer side of the second collar at a first position on the circumference of the second collar, and extends back from the outer side to the inner side of the second collar at a second position, which is different from the first position, on the circumference of the second collar, and extends to the first collar across the outer circumference of the winding, the difference between the position of the end of a desired turn of the winding wound about the drum core and positions of the lead sections of the first collar can be absorbed, and the number of turns of the wire can be adjusted in detail below one turn.

The advantages by the second solving means are as follows. That is, since the wire may extend across the outer circumference of the winding without contact with the surface of the winding, the floating capacitance between the winding and the wire can be reduced, and the variations among inductance values can be reduced, which results in a narrow deviation. Furthermore, the leading wire of the winding and the trailing wire are not close, which can prevent the occurrence of a layer short.

The advantages by the third solution are as follows. That is, since multiple latches for latching the lead extending across the circumference of the other collar of the drum core may be provided on the collar with an equal angle, the position where the trailing wire of the winding extends across the circumference of the other collar can be adjusted in more details by a predetermined step equal to or below 0.5 turn. Thus, the inductance value of the radial lead type inductor can be adjusted in more detail by a predetermined step width. Furthermore, since both ends of the wire across the outer side of the other collar are latched, the overslip of the wire from the collar can be prevented.

The advantages by the fourth solving means are as follows. That is, since the other collar of the drum core has a polygonal shape, the position where the trailing wire of the winding wound about the scroll of the drum core extends across the circumference of the other collar can be adjusted in more details by a predetermined step equal to or below 0.5 turn even when the other collar does not have extra sections for latching the wire to a groove or a hole. Thus, the inductance value of the radial lead type inductor can be adjusted in more detail by a predetermined step width. Furthermore, the wire across the outer side of the other collar can be prevented from overslipping from the other collar.

There can be provided a radial lead type inductor, which can address detail needs for inductance values by adjusting the number of turns of a wire thereof in blocks of 1.0 or smaller turn and thus interpolating middle inductance values, which have been difficult to obtain in the radial lead type inductor of the related art.

DETAILED DESCRIPTION OF CERTAIN EMBODIMENTS

Figure 1A:
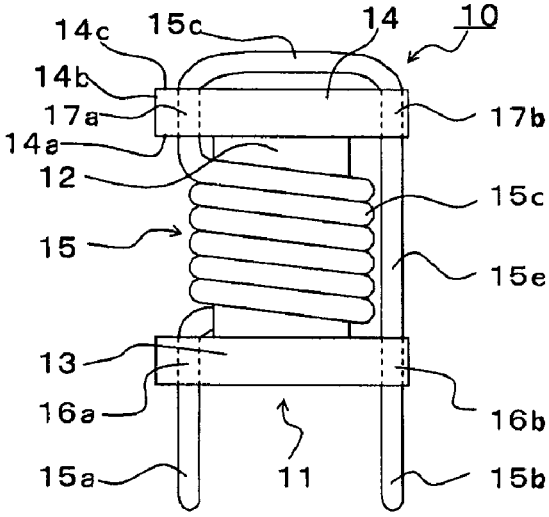
FIGS. 1A and 1B are diagrams showing external views of a first embodiment of a radial lead type inductor.
Figure 1B:
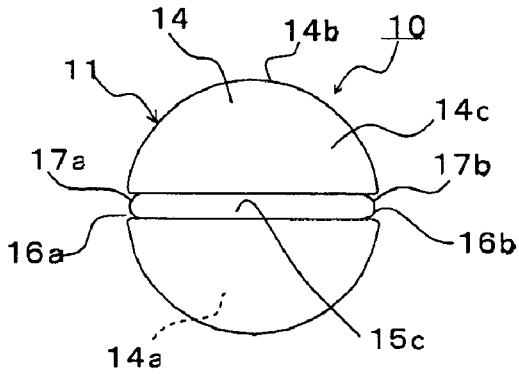

With reference to FIGS. 1A and 1B, a first embodiment of a radial lead type inductor will be described below. FIGS. 1A and 1B are diagrams showing external views of a radial lead type inductor 10 of a first embodiment. FIG. 1A is a front view of the first embodiment, and FIG. 1B is a plan view of the first embodiment.

The entire structure of the radial lead type inductor 10 of this embodiment includes a drum core 11, as shown in FIGS. 1A and 1B, and a wire 15 is wound about a scroll 12 of the drum core 11.

More specifically, this embodiment is a radial lead type inductor 10, including a drum core 11 having a scroll 12 and planer one and other collars 13 and 14, which are provided at one and other ends of the scroll 12 and are orthogonal to the scroll 12, a winding 15*c* formed by a wire 15 wound about the scroll 12 of the drum core 11, and lead terminals, which are the beginning 15*a* and end 15*b* of the wire 15 led in parallel from lead sections 16*a* and 16*b* spaced apart with a predetermined pitch in the one collar 13, wherein the trailing wire 15 of the winding 15*c* extends from the inner side 14*a* of the other collar 14, which faces against the one collar 13, to the outer side 14*c* of the collar 14 through an arbitrary position on the circumference 14*b* of the other collar 14, extends back from the outer side 14*c* to the inner side 14*a* of the collar 14 across the outer side 14*c* of the collar 14 and through a position, which is different from the arbitrary position, on the circumference 14*b* of the other collar 14, and is led from the lead section 16*b* of the one collar 13 across the outer circumference of the winding 15*c*.

In the first embodiment, the wire 15 may extend across the outer circumference of the winding 15*c* without contact with the surface of the winding 15*c*.

The drum core 11 used in the first embodiment may have a scroll 12 and substantially-disk-shaped one and other collars 13 and 14, which are provided at one and other ends of the scroll 12 and are orthogonal to the scroll 12, and the collar 14 has two latches 17*a* and 17*b* for latching the wire 15 extending across the circumference 14*b* of the collar 14 with an equal angle.

The number of turns of the winding 15*c* wound about the scroll 12 of the drum core 11 of the first embodiment is, e.g., 6.0 T. More specifically, the beginning 15*a* of the wire 15 wound about the scroll 12 of the drum core 11 is led from the lead section 16*a*, which is a groove, on the one collar 13 of the drum core 11. The trailing wire 15 of the winding 15*c*, which is wound about the scroll 12 by 6.0 T, extends from the inner side 14*a* of the other collar 14, which faces against the one collar 13, to the outer side 14*c* of the collar 14 along the latch 17*a* for latching the wire 15, which are two grooves with an equal angle on the other collar 14 of the drum core 11, crosses the outer side 14*c* of the collar 14 from the latch 17*a* to the latch 17*b*, which is a groove facing against the latch 17*a* through the axial center of the drum core 11, crosses back the circumference 14*b* of the other collar 14 from the outer side 14*c* to the inner side 14*a* of the collar 14 along the latch 17*b*, and is led from the lead section 16*b*, which is a groove, on the one collar 13 across the outer circumference of the winding 15*c* without contact with the surface of the winding 15*c* and in parallel with the beginning 15*a* of the wire 15.

The wire 15 is fixed to the drum core 11 with an adhesive, not shown, at the lead sections 16*a* and 16*b* of the one collar 13 of the drum core 11.

The drum core 11 of the radial lead type inductor 10 may contain an insulating material with a high magnetic permeability, which mainly contains Ni—Zn Ferrite or Ni—Zn—Cu Ferrite. The insulating material may be properly selected in accordance with the application of the radial lead type inductor 10. The drum core 11 can be obtained by mixing the powder of the insulating material and a binder, granulating the mix, molding the resultant granules into a predetermined form by using a powder molding press, performing debinding processing thereon at about 800° C., and burning the result at a predetermined temperature based on the sintering temperature of the insulating material. The material of the drum core 11 is not limited to an insulating material with a high magnetic permeability as described above but may be a resin composite material, which can be obtained by molding a mix of the powder of the insulating material with a high magnetic permeability, powder of a low resistance magnetic material such as Mn—Zn Ferrite and a metallic magnetic material and an insulating resin such as an epoxy resin within a die in a predetermined form.

The form of the drum core 11 is preferably a drum shape in which one and other ends of the scroll 12 about which the wire 15 is wound have the pair of planer collars 13 and 14 so as to be orthogonal to the scroll 12 and integrally to or separately from the scroll 12. The drum core may contain a combination of the insulating material with a high magnetic permeability and the resin composite material.

The wire 15 to be wound about the scroll 12 of the drum core 11 may be a wire of metal such as copper, which is insulated with a polyurethane resin or a polyester resin. The wire of metal may be a solid or stranded wire.

The lead sections 16*a* and 16*b* with a predetermined pitch on the one collar 13 of the drum core 11 may be generally grooves in the direction of thickness on the circumference of the one collar 13 but is not limited thereto. The lead sections 16*a* and 16*b* may be holes through the one collar 13 in the direction of thickness. Alternatively, one lead section may be a hole while the other lead section may be a groove.

The latches 17*a* and 17*b* for latching the wire 15 across the circumference 14*b* of the collar 14 of the drum core 11 in the other collar 14 may be grooves, holes or the combination, like the lead sections 16*a* and 16*b* of the one collar 13.

The forms of the one collar 13 and other collar 14 of the drum core 11 may be selectively a disk shape or a polygonal plate shape in the plan view, and the forms of the one collar 13 and other collar 14 are not necessarily identical.

The latches 17*a* and 17*b* for latching the wire 15 across the circumference 14*b* of the other collar 14 of the drum core 10 in the collar 14 are preferably provided at positions facing against the lead sections 16*a* and 16*b* in the one collar 13 of the drum core 10 but are not limited thereto. The latches 17*a* and 17*b* may be provided near the positions facing against the lead sections 16*a* and 16*b*. Alternatively, latches for latching the wire 15 may be added at positions excluding the positions facing against the lead sections 16*a* and 16*b*.

In the radial lead type inductor 10 of the first embodiment, the winding 15*c* has 6.0 T, which is a middle number of turns between 5.5 T and 6.6 T in radial lead type inductors of the related art. Therefore, the inductance values can be interpolated, which have been difficult to obtain in the past in the radial lead type inductors of the related art. This embodiment thus provides an inductance value more closer to a value desired by a user.

Figure 2A:
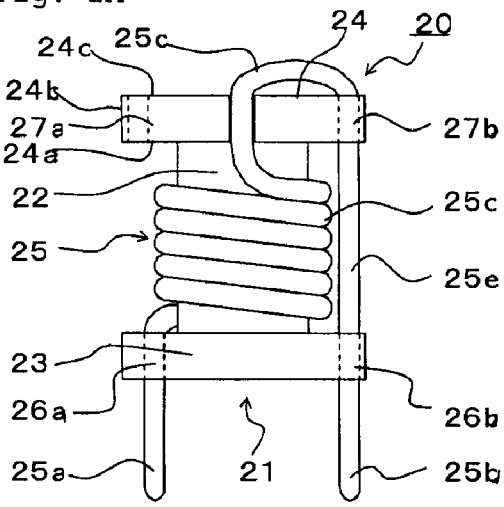
FIGS. 2A and 2B are diagrams showing external views of a second embodiment of a radial lead type inductor.
Figure 2B:
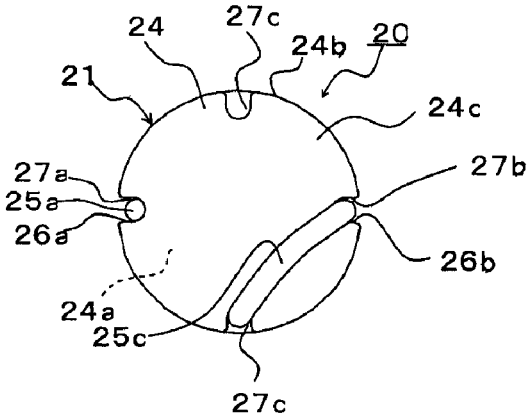

With reference to FIGS. 2A and 2B, a second embodiment of the radial lead type inductor will be described next. FIGS. 2A and 2B are diagrams showing external views of a radial lead type inductor 20 of a second embodiment. FIG. 2A is a front view of the second embodiment, and FIG. 2B is a plan view of the second embodiment.

The radial lead type inductor 20 of this embodiment is the same as the first embodiment in the entire structure and specific constructions, which will be described later, but is different from the first embodiment in the form of collars of the drum core, which will be described later, (including the number and layout of latches for latching the wire) and the number of turns of the winding wound about the scroll of the drum core (including the position where the trailing wire of the winding crosses the other collar and the layout of the wire across the outer side of the other collar).

The entire structure of the radial lead type inductor 20 of this embodiment includes a drum core 21, as shown in FIGS. 2A and 2B, and a wire 25 is wound about a scroll 22 of the drum core 21.

More specifically, this embodiment is a radial lead type inductor 20, including a drum core 21 having a scroll 22 and planer one and other collars 23 and 24, which are provided at one and other ends of the scroll 22 and are orthogonal to the scroll 22, a winding 25*c* formed by a wire 25 wound about the scroll 22 of the drum core 21, and lead terminals, which are the beginning 25*a* and end 25*b* of the wire 25 led in parallel from lead sections 26*a* and 26*b* spaced apart with a predetermined pitch in the one collar 23, wherein the trailing wire 25 of the winding 25*c* extends from the inner side 24*a* of the other collar 24, which faces against the one collar 23, to the outer side 24*c* of the collar 24 through an arbitrary position on the circumference 24*b* of the other collar 24, extends back from the outer side 24*c* to the inner side 24*a* of the collar 24 across the outer side 24*c* of the collar 24 and through a position, which is different from the arbitrary position, on the circumference 24*b* of the other collar 24, and is led from the lead section 26*b* of the one collar 23 across the outer circumference of the winding 25*c*.

The drum core 21 used in the second embodiment may have a scroll 22 and substantially-disk-shaped one and other collars 23 and 24, which are provided at one and other ends of the scroll 22 and are orthogonal to the scroll 22, and the collar 24 has four latches 27*a*, 27*b*, 27*c* and 27*d* for latching the wire 25 extending on the circumference 24*b* of the collar 24 with an equal angle.

The number of turns of the winding 25*c* wound about the scroll 22 of the drum core 21 of the second embodiment is 5.75 T. More specifically, the beginning 25*a* of the wire 25 wound about the scroll 22 of the drum core 21*a* is led from the lead section 26*a*, which is a groove, on the one collar 23 of the drum core 21. The trailing wire 25 of the winding 25*c*, which is wound about the scroll 22 by 5.75 T, crosses the circumference 24*b* of the other collar 24 from the inner side 24*a* of the other collar 24, which faces against the one collar 23, to the outer side 24*c* of the collar 24 along one latch 27*d* of the latch 27 for latching the wire 25, which are four grooves with an equal angle on the other collar 24 of the drum core 21, crosses the outer side 24*c* of the other collar 24 to the latch 27*b* at the position displaced from the latch 27*d* by 90 degrees in the counterclockwise direction, extends back from the outer side 24*c* to the inner side 24*a* of the collar 24 across the circumference 24*b* of the other collar 24 along the latch 27*b*, and is led from the lead section 26*b*, which is a groove, on the one collar 23 across the outer circumference of the winding 25*c* without contact with the surface of the winding 25*c* and in parallel with the beginning 25*a* of the wire 25.

The wire 25 is fixed to the drum core 21 with an adhesive, not shown, at the lead sections 26*a* and 26*b* of the one collar 23 of the drum core 21, like the first embodiment.

In the radial lead type inductor 20 of the second embodiment, the winding 25*c* has 5.75 T, which is a middle number of turns between 5.5 T in a radial lead type inductor of the related art and 6.0 T in the radial lead type inductor of the first embodiment. Therefore, the inductance value can be interpolated in more detail, which has been difficult to obtain in the past in the radial lead type inductors of the related art.

Figure 3A:
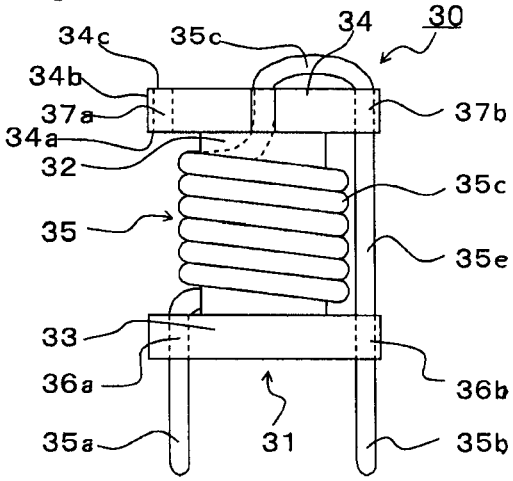
FIGS. 3A and 3B are diagrams showing external views of a third embodiment of a radial lead type inductor.
Figure 3B:
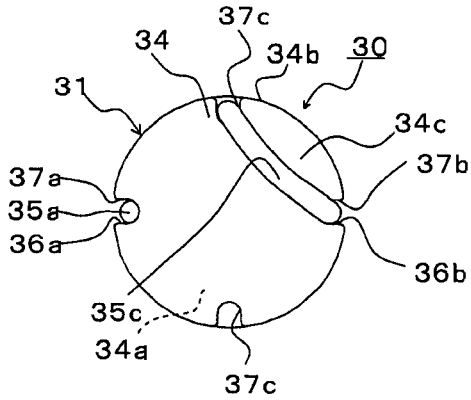

With reference to FIGS. 3A and 3B, a third embodiment of the radial lead type inductor will be described next. FIGS. 3A and 3B are diagrams showing external views of a radial lead type inductor 30 of a third embodiment. FIG. 3A is a front view of the third embodiment, and FIG. 3B is a plan view of the third embodiment.

The radial lead type inductor 30 of this embodiment is the same as the first and second embodiments in the entire structure and specific constructions, which will be described later, and is the same as the second embodiment in the form of the collars of the drum core (including the number and layout of latches for latching the wire) and is different from the first and second embodiments in the number of turns of the winding wound about the scroll of the drum core (including the position where the trailing wire of the winding crosses the other collar and the layout of the wire across the outer side of the other collar).

The entire structure of the radial lead type inductor 30 of this embodiment includes a drum core 31, as shown in FIGS. 3A and 3B, and a wire 35 is wound about a scroll 32 of the drum core 31.

More specifically, this embodiment is a radial lead type inductor 30, including a drum core 31 having a scroll 32 and planer one and other collars 33 and 34, which are provided at one and other ends of the scroll 32 and are orthogonal to the scroll 32, a winding 35*c* formed by a wire 35 wound about the scroll 32 of the drum core 31, and lead terminals, which are the beginning 35*a* and end 35*b* of the wire 35 led in parallel from lead sections 36*a* and 36*b* spaced apart with a predetermined pitch in the one collar 33, wherein the trailing wire 35 of the winding 35*c* extends from the inner side 34*a* of the other collar 34, which faces against the one collar 33, to the outer side 34*c* of the collar 34 through an arbitrary position on the circumference 34*b* of the other collar 34, extends back from the outer side 34*c* to the inner side 34*a* of the collar 34 through the outer side 34*c* of the collar 34 and a position, which is different from the arbitrary position, on the circumference 34*b* of the other collar 34, and is led from the lead section 36*b* of the one collar 33 through the outer circumference of the winding 35*c*.

The drum core 31 used in the third embodiment may have a scroll 32 and substantially-disk-shaped one and other collars 33 and 34, which are provided at one and other ends of the scroll 32 and are orthogonal to the scroll 32, and further has four latches 37*a*, 37*b*, 37*c* and 37*d* for latching the wire 35 extending across the circumference 34*b* of the collar 34 with an equal angle.

The number of turns of the winding 35*c* wound about the scroll 32 of the drum core 31 of the third embodiment is 6.25 T. More specifically, the beginning 35*a* of the wire 35 wound about the scroll 32 of the drum core 31 is led from the lead section 36*a*, which is a groove, on the one collar 33 of the drum core 31. The trailing wire 35 of the winding 35*c*, which is wound about the scroll 32 by 6.25 T, crosses the circumference 34*b* of the other collar 34 from the inner side 34*a* of the other collar 34, which faces against the one collar 33, to the outer side 34*c* of the collar 34 along one latch 37*c* of the latch 37 for latching the wire 35, which are four grooves with an equal angle on the other collar 34 of the drum core 31, crosses the outer side 34*c* of the collar 34 from the latch 37*c* to the latch 37*b* at the position displaced therefrom by 90 degrees in the clockwise direction, crosses back the circumference 34*b* of the other collar 34 along the latch 37*b* from the outer side 34*c* to the inner side 34*a* of the collar 34, and is led from the lead section 36*b*, which is a groove, on the one collar 33 across the outer circumference of the winding 35*c* without contact with the surface of the winding 35*c* and in parallel with the beginning 35*a* of the wire 35.

The wire 35 is fixed to the drum core 31 with an adhesive, not shown, at the lead sections 36*a* and 36*b* of the one collar 33 of the drum core 31, like the first and second embodiments.

In the radial lead type inductor 30 of the third embodiment, the winding 35*c* has 6.25 T, which is a middle number of turns between 6.5 T in a radial lead type inductor of the related art and 6.0 T in the radial lead type inductor of the first embodiment. Therefore, like the second embodiment, the inductance value can be interpolated in more detail, which has been difficult to obtain in the past in the radial lead type inductors of the related art.

Figure 4A:
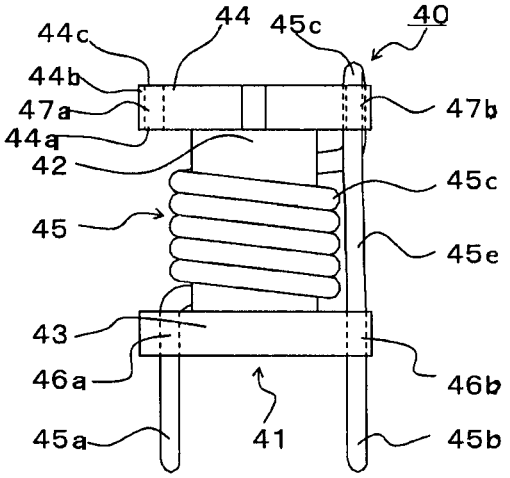
FIGS. 4A and 4B are diagrams showing external views of a fourth embodiment of a radial lead type inductor.
Figure 4B:
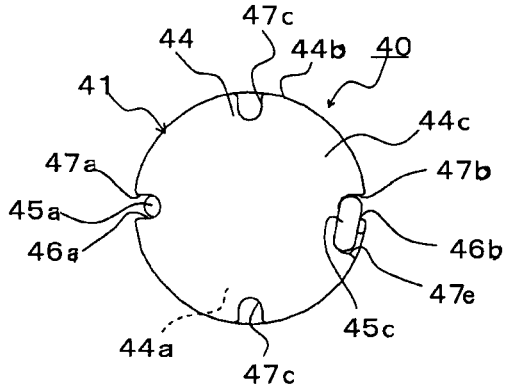

With reference to FIGS. 4A and 4B, a fourth embodiment of the radial lead type inductor will be described next. FIGS. 4A and 4B are diagrams showing external views of a radial lead type inductor 40 of a fourth embodiment. FIG. 4A is a front view of the fourth embodiment, and FIG. 4B is a plan view of the fourth embodiment.

The radial lead type inductor 40 of this embodiment is the same as the first to third embodiments in the entire structure and specific constructions, which will be described later, and is different from the first to third embodiments in the form of the collars of the drum core (including the number and layout of latches for latching the wire) and the number of turns of the winding wound about the scroll of the drum core (including the position where the trailing wire of the winding crosses the other collar and the layout of the wire across the outer side of the other collar).

The entire structure of the radial lead type inductor 40 of this embodiment includes a drum core 41, as shown in FIGS. 4A and 4B, and a wire 45 is wound about a scroll 42 of the drum core 41.

More specifically, this embodiment is a radial lead type inductor 40, including a drum core 41 having a scroll 42 and planer one and other collars 43 and 44, which are provided at one and other ends of the scroll 42 and are orthogonal to the scroll 42, a winding 45*c* formed by a wire 45 wound about the scroll 42 of the drum core 41, and lead terminals, which are the beginning 45*a* and end 45*b* of the wire 45 led in parallel from lead sections 46*a* and 46*b* spaced apart with a predetermined pitch in the one collar 43, wherein the trailing wire 45 of the winding 45*c* extends from the inner side 44*a* of the other collar 44, which faces against the one collar 43, to the outer side 44*c* of the collar 44 through an arbitrary position on the circumference 44*b* of the other collar 44, extends back from the outer side 44*c* to the inner side 44*a* of the collar 44 across the outer side 44*c* of the collar 44 and through a position, which is different from the arbitrary position, on the circumference 44*b* of the other collar 44, and is led from the lead section 46*b* of the one collar 43 across the outer circumference of the winding 45*c*.

The drum core 41 used in the fourth embodiment may have a scroll 42 and substantially-disk-shaped one and other collars 43 and 44, which are provided at one and other ends of the scroll 42 and are orthogonal to the scroll 42, and the collar 44 has four latches 47*a*, 47*b*, 47*c* and 47*d* for latching the wire 45 extending across the circumference 44*b* of the collar 44 with an equal angle and a fifth latch 47*e* at the position between the latch 47*b* and the latch 47*d* and closer to the latch 47*b*.

The number of turns of the winding 45*c* wound about the scroll 42 of the drum core 41 of the third embodiment is 6.25 T. More specifically, the beginning 45*a* of the wire 45 wound about the scroll 42 of the drum core 41 is led from the lead section 46*a*, which is a groove, on the one collar 43 of the drum core 41. The trailing wire 45 of the winding 45*c*, which is wound about the scroll 42 by 5.5 T, crosses the circumference 44*b* of the other collar 44 from the inner side 44*a* of the other collar 44, which faces against the one collar 43, to the outer side 44*c* of the collar 44 along one latch 47*b* of the latch 47 for latching the wire 45, which are four grooves with an equal angle on the other collar 44 of the drum core 41, crosses the outer side 44*c* of the collar 44 from the latch 47*b* to the fifth latch 47*e* at a position close to the latch 47*b* in the clockwise direction, crosses back the circumference 44*b* of the other collar 44 from the outer side 44*c* to the inner side 44*a* of the collar 44 along the latch 47*e*, and is led from the lead section 46*b*, which is a groove, on the one collar 43 across the outer circumference of the winding 45*c* without contact with the surface of the winding 45*c* the wire 45 and in parallel with the beginning 45*a* of the wire 45.

The wire 45 is fixed to the drum core 41 with an adhesive, not shown, at the lead sections 46*a* and 46*b* of the one collar 43 of the drum core 41, like the first to third embodiments.

In the radial lead type inductor 40 of the fourth embodiment, the winding 45*c* has 5.5 T, which is equal to 5.5 T in a radial lead type inductor of the related art. Therefore, the radial lead type inductor 40 can be replaced by the radial lead type inductors of the related art.

Though, in the radial lead type inductors of the first to third embodiments, a wire extends from latches for latching the wire to a position of the other collar, which faces against the lead section of the one collar, to the lead section of the one collar across the outer circumference of the winding vertically, the invention is not limited thereto. Like the fourth embodiment, the wire may extend from the latch 47*e* of the other collar to the lead section 47*b* of the one collar 43 diagonally across the outer circumference of the winding, which does not bring the winding 45*c* closely to the wire 45*e* across the outer circumference of the winding, like the first to third embodiments.

Figure 5A:
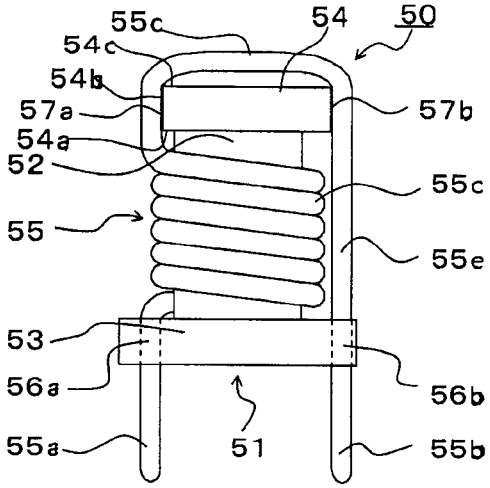
FIGS. 5A and 5B are diagrams showing external views of a fifth embodiment of a radial lead type inductor.
Figure 5B:
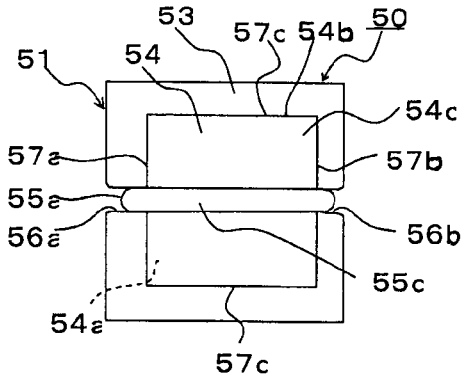

With reference to FIGS. 5A and 5B, a fifth embodiment of the radial lead type inductor will be described next. FIGS. 5A and 5B are diagrams showing external views of a radial lead type inductor 50 of a fifth embodiment. FIG. 5A is a front view of the fifth embodiment, and FIG. 5B is a plan view of the fifth embodiment.

The radial lead type inductor 50 of this embodiment is the same as the first to fourth embodiments in the entire structure and specific constructions, which will be described later, but is different from the first to fourth embodiments in the form of collars of the drum core, which will be described later (including the number and layout of latches for latching the wire) and is the same as the first embodiment in the number of turns of the winding wound about the scroll of the drum core (including the position where the trailing wire of the winding extends across the other collar and the layout of the wire across the outer side of the other collar).

The entire structure of the radial lead type inductor 50 of this embodiment includes a drum core 51, as shown in FIGS. 5A and 5B, and a wire 55 is wound about a scroll 52 of the drum core 51.

More specifically, this embodiment is a radial lead type inductor 50, including a drum core 51 having a scroll 52 and planer one and other collars 53 and 54, which are provided at one and other ends of the scroll 52 and are orthogonal to the scroll 52, a winding 55*c* formed by a wire 55 wound about the scroll 52 of the drum core 51, and lead terminals, which are the beginning 55*a* and end 55*b* of the wire 55 led in parallel from lead sections 56*a* and 56*b* spaced apart with a predetermined pitch in the one collar 53, wherein the trailing wire 55 of the winding 55*c* extends from the inner side 54*a* of the other collar 54, which faces against the one collar 53, to the outer side 54*c* of the collar 54 through an arbitrary position on the circumference 54*b* of the other collar 54, extends back from the outer side 54*c* to the inner side 54*a* of the collar 54 across the outer side 54*c* of the collar 54 and a position, which is different from the arbitrary position, on the circumference 54*b* of the other collar 54, and is led from the lead section 56*b* of the one collar 53 across the outer circumference of the winding 55*c*.

The drum core 51 used in the fifth embodiment may have a scroll 52 and a substantially-square-shaped one collar 53 and square-shaped another collar 54, which are provided at one and other ends of the scroll 52 and are orthogonal to the scroll 52, and the collar 54 has a pair of sides 57*a* and 57*b* for latching the wire 55 extending across the circumference 54*b* of the collar 54.

The number of turns of the winding 55*c* wound about the scroll 52 of the drum core 51 of the fifth embodiment is 6.0 T, like the first embodiment. More specifically, the beginning 55*a* of the wire 55 wound about the scroll 52 of the drum core 51 is led from the lead section 56*a*, which is a groove, on the one collar 53 of the drum core 51. The trailing wire 55 of the winding 55*c*, which is wound about the scroll 52 by 6.0 T, crosses the circumference 54*b* of the other collar 54 on the side 57*a* of the other collar 54 of the drum core 51 from the inner side 54*a* of the other collar 54, which faces against the one collar 53, to the outer side 54*c* of the collar 54, crosses the outer side 54*c* of the collar 54 from the side 57*a* to the side 57*b*, which faces against the side 57*a* through the axial center of the drum core 51, crosses back the circumference 54*b* of the other collar 54 on the side 57*b* from the outer side 54*c* to the inner side 54*a* of the collar 54, and is led from the lead section 56*b* of the one collar 53 across the outer circumference of the winding 55*c* without contact with the surface of the winding 55*c* and in parallel with the beginning 55*a* of the wire 55.

The wire 55 is fixed to the drum core 51 with an adhesive, not shown, at the lead sections 56*a* and 56*b* of the one collar 53 of the drum core 51.

In the radial lead type inductor 50 of the fifth embodiment, the winding 55*c* has 6.0 T, which is a middle number of turns between 5.5 T and 6.6 T in radial lead type inductors of the related art. Therefore, the inductance value can be interpolated, which has been difficult to obtain in the past in the radial lead type inductors of the related art.

Figure 6A:
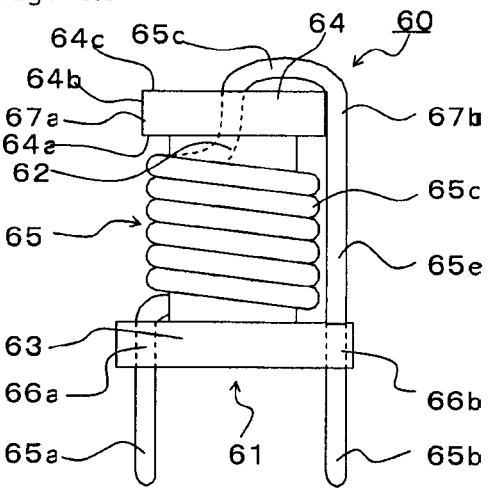
FIGS. 6A and 6B are diagrams showing external views of a sixth embodiment of a radial lead type inductor.
Figure 6B:
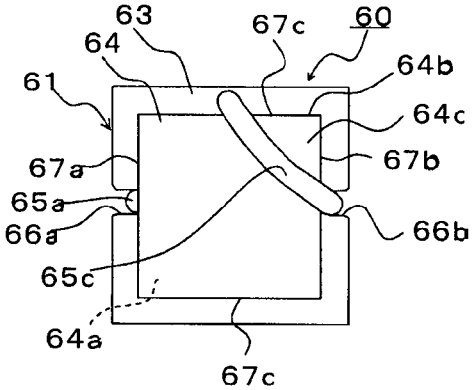
Figure 7A:
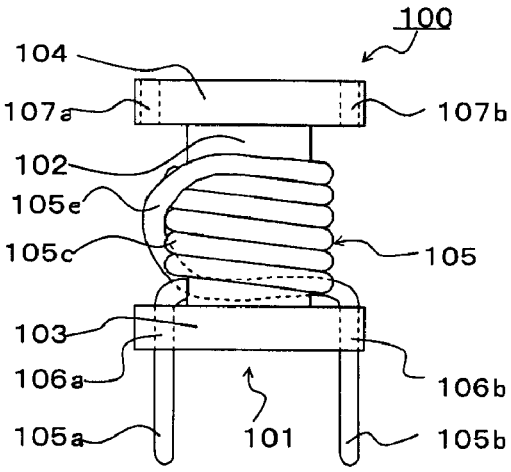
FIGS. 7A and 7B are diagrams showing external views of a radial lead type inductor of the related art.
Figure 7B:
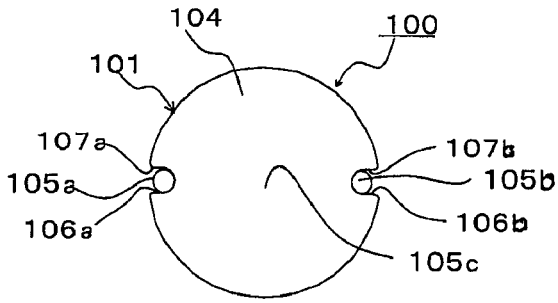
PRIOR ART Fig. 7B

With reference to FIGS. 6A and 6B, a sixth embodiment of the radial lead type inductor will be described next. FIGS. 6A and 6B are diagrams showing external views of a radial lead type inductor 60 of a sixth embodiment. FIG. 6A is a front view of the sixth embodiment, and FIG. 6B is a plan view of the sixth embodiment.

The radial lead type inductor 60 of this embodiment is the same as the first to fifth embodiments in the entire structure and specific constructions, which will be described later, is the same as the fourth embodiment in the form of the collars of the drum core (including the number and layout of latches for latching the wire) and is the same as the third embodiment in the number of turns of the winding wound about the scroll of the drum core (including the position where the trailing wire of the winding crosses the other collar and the layout of the wire across the outer side of the other collar).

The entire structure of the radial lead type inductor 60 of this embodiment includes a drum core 61, as shown in FIGS. 6A and 6B, and a wire 65 is wound about a scroll 62 of the drum core 61.

More specifically, this embodiment is a radial lead type inductor 60, including a drum core 61 having a scroll 62 and planer one and other collars 63 and 64, which are provided at one and other ends of the scroll 62 and are orthogonal to the scroll 62, a winding 65*c* formed by a wire 65 wound about the scroll 62 of the drum core 61, and lead terminals, which are the beginning 65*a* and end 65*b* of the wire 65 led in parallel from lead sections 66*a* and 66*b* spaced apart with a predetermined pitch in the one collar 63, wherein the trailing wire 65 of the winding 65*c* extends from the inner side 64*a* of the other collar 64, which faces against the one collar 63, to the outer side 64*c* of the collar 64 through an arbitrary position on the circumference 64*b* of the other collar 64, extends back from the outer side 64*c* to the inner side 64*a* of the collar 64 across the outer side 64*c* of the collar 64 and a position, which is different from the arbitrary position, on the circumference 64*b* of the other collar 64, and is led from the lead section 66*b* of the one collar 63 across the outer circumference of the winding 65*c*.

The drum core 61 used in the sixth embodiment may have a scroll 62 and a substantially-square-shaped one collar 63 and a square-shaped other collar 64, which are provided at one and other ends of the scroll 62 and are orthogonal to the scroll 62, and the collar 64 has four sides 67*a*, 67*b*, 67*c* and 67*d* for latching the wire 65 extending across the circumference 64*b* of the collar 64.

The number of turns of the winding 65*c* wound about the scroll 62 of the drum core 61 of the sixth embodiment is 6.25

T, like the third embodiment. More specifically, the beginning 65*a* of the wire 65 wound about the scroll 62 of the drum core 61 is led from the lead section 66*a,* which is a groove, on the one collar 63 of the drum core 61. The trailing wire 65 of the winding 65*c,* which is wound about the scroll 62 by 6.25 T, crosses the circumference 64*b* of the other collar 64 on the side 67*c* of the other collar 64 of the drum core 61 from the inner side 64*a* of the other collar 64, which faces against the one collar 63, to the outer side 64*c* of the collar 64, crosses the outer side 64*c* of the collar 64 from the side 67*c* to the side 67*b,* which is adjacent to the side 67*c* through across one angle of the collar 64, crosses back the circumference 64*b* of the other collar 64 on the side 67*b* from the outer side 64*c* to the inner side 64*a* of the collar 64, and is led from the lead section 66*b,* which is a groove, on the one collar 63 across the outer circumference of the winding 65*c* without contact with the surface of the winding 65*c* and in parallel with the beginning 65*a* of the wire 65.

The wire 65 is fixed to the drum core 61 with an adhesive, not shown, at the lead sections 66*a* and 66*b* of the one collar 63 of the drum core 61, like the first to fifth embodiments.

In the radial lead type inductor 60 of the sixth embodiment, the winding 65*c* has 6.25 T, which is a middle number of turns between 6.5 T in a radial lead type inductor of the related art and 6.0 T in the radial lead type inductor of the fifth embodiment. Therefore, the inductance values can be interpolated in more detail, which have been difficult to obtain in the past in the radial lead type inductors of the related art.

These embodiments are suitable for a radial lead type inductor to be implemented by using a radial lead type electronic part automatic inserting apparatus.

The foregoing description details certain embodiments of the invention. It will be appreciated, however, that no matter how detailed the foregoing appears in text, the invention may be practiced in many ways. It should be noted that the use of particular terminology when describing certain features or aspects of the invention should not be taken to imply that the terminology is being re-defined herein to be restricted to including any specific characteristics of the features or aspects of the invention with which that terminology is associated.

While the above detailed description has shown, described, and pointed out novel features of the invention as applied to various embodiments, it will be understood that various omissions, substitutions, and changes in the form and details of the device or process illustrated may be made by those skilled in the technology without departing from the spirit of the invention. The scope of the invention is indicated by the appended claims rather than by the foregoing description. All changes which come within the meaning and range of equivalency of the claims are to be embraced within their scope.

What is claimed is:

1. A radial lead type inductor, comprising:

a drum core comprising a scroll and first and second collars at first and second ends of the scroll;

a winding formed by a wire wound about the scroll of the drum core; and lead terminals, which are formed by the beginning and end of the wire led in parallel from lead sections spaced apart with a predetermined pitch in the first collar, wherein:

the trailing wire of the winding extends from the inner side of the second collar to the outer side of the second collar at a first position on the circumference of the second collar, and extends back from the outer side to the inner side of the second collar at a second position, which is different from the first position, on the circumference of the second collar, and extends to the first collar across the outer circumference of the winding.

2. The radial lead type inductor according to claim 1, wherein the wire extends across the outer circumference of the winding without contact with the surface of the winding.

3. The radial lead type inductor according to claim 1, wherein multiple latches for latching the wire extending across the circumference of the other collar of the drum core is provided on the second collar with an equal angle.

4. The radial lead type inductor according to claim 1, wherein the second collar of the drum core has a polygonal shape.

5. The radial lead type inductor according to claim 1, wherein the second collar of the drum core has a disk shape.

* * * * *